United States Patent [19]

Düve

[11] Patent Number: 4,622,306

[45] Date of Patent: Nov. 11, 1986

[54] PROCESS FOR PROTECTING STEAM GENERATORS FROM MATERIAL DAMAGE

[75] Inventor: Hans Düve, Gladbeck, Fed. Rep. of Germany

[73] Assignee: Chemische Werke Huls Aktiengesellschaft, Marl, Fed. Rep. of Germany

[21] Appl. No.: 640,583

[22] Filed: Aug. 14, 1984

[30] Foreign Application Priority Data

Aug. 25, 1983 [DE] Fed. Rep. of Germany ..... 3330598

[51] Int. Cl.[4] ..... G01N 21/00; G01N 23/12; G01N 35/08

[52] U.S. Cl. ..... 436/150; 122/403; 250/435; 422/14; 422/24; 422/62; 436/38; 436/55

[58] Field of Search ..... 422/24, 62, 14, 110, 422/905; 436/55, 38, 150; 122/398, 403, 401, 379; 210/748, 746; 250/435 X; 324/439

[56] References Cited

U.S. PATENT DOCUMENTS

| | | | |
|---|---|---|---|
| Re. 31,507 | 1/1984 | Frost, III | 210/748 X |
| 1,926,953 | 9/1933 | McGill | 122/401 X |
| 3,158,444 | 11/1964 | Larson et al. | 436/38 |
| 3,267,361 | 8/1966 | Maddox | 324/439 |

*Primary Examiner*—Barry S. Richman
*Assistant Examiner*—Lynn M. Kummert
*Attorney, Agent, or Firm*—Antonelli, Terry & Wands

[57] ABSTRACT

Decomposable organic compounds can, at times, be contained in the feedwater for steam generators; these decomposable compounds can stem from the untreated water supply or from the recondensate if the steam is utilized as heating steam for chemical plants and the condensate is recycled into the steam generator. The decomposition products can lead to damage to the material in the steam generator during long-term exposure.

A partial stream of the feedwater is continuously examined for such compounds; as soon as these occur, they are disintegrated in the partial stream by UV light. The decomposition products are detected by measuring conductivity and/or by means of ion-sensitive electrodes. This measuring process works very rapidly and is highly sensitive, making it possible to consistently recognize contaminated water quantities and then to remove same in a controlled fashion from the feedwater stream for the steam generator or to process same into unobjectionable feedwater.

The process permits the saving of large amounts of fresh feedwater, especially in steam generators with power-heat linkage in chemical plants.

6 Claims, 4 Drawing Figures

PROCESS FOR PROTECTING STEAM GENERATORS FROM MATERIAL DAMAGE

Figure 1:
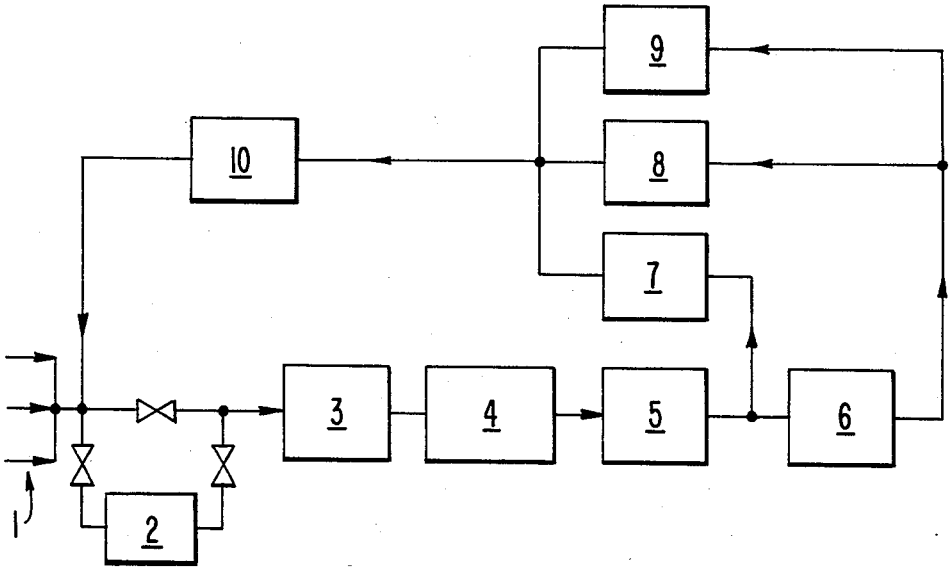
FIG. 1. (PRIOR ART)

The invention relates to a process for protecting steam generators against material damage and other negative effects (for example, anomalies of the protective magnetite coating), caused by decomposition products of decomposable compounds contained in the feedwater.

The invention has the objective of quickly and safely detecting the decomposable compounds contained in the feedwater for the steam generator, down to very low concentrations, in order to transfer out any objectionable feedwater from the feedwater stream before the feedwater enters the steam generator, or in order to initiate other prior measures which reduce the content of decomposable compounds in the water. Thereby considerable quantities of fresh feedwater can be saved. The steam generator and the subsequently arranged installations can be protected from the effect of the decomposition products.

As is known, steam generators are charged only with a specially processed water, i.e. fully demineralized water. The conductivity of this normally salt-free feedwater must lie below a predetermined limit value. Furthermore, it must be practically free of impurities causing deposits in the water and steam conduits or decomposing within the stem generator.

Sometimes the feedwater can contain nonionic compounds preferably organic materials which cannot be removed by means of an ion exchanger. Such compounds can be contained at times in the recondensate recycled from steam-heated chemical plants; however, as experience has shown, they can occur also in freshly processed feedwater. If these compounds pass into the steam generator, they can be decomposed hydrothermally into inorganic fragments (ions).

Such decomposable material can be nearly any nonionic organic compound containing carbon, hydrogen and/or oxygen only or containing additionally any other element as e.g., one of the halogens, sulfur, phosphorus, nitrogen. All organic compounds are soluble in water at least in a concentration being high enough to cause after decomposition an increase in conductivity of the water which is higher than the permitted conductivity of feedwater for steam generators.

The recondensate recycled from steam-heated chemical plants can contain small amounts (i.e., some ppm) of some or all of the chemical substances which are used or produced in the plant due to leakages between the conduits and containers for the chemical substances on the one hand and the steam and condensate ducts on the other hand if the pressure on the side of the chemical substances is higher than the pressure in the steam or condensate ducts.

Small amounts (i.e., some ppm) of several organic substances can be present in freshly processed feedwater if it is made from contaminated surface water (e.g., river water). Even if the water is raised from water-bearing strata near the ground sometimes organic substances from the soil are dissolved in the water.

The process according to the invention is preferably applied to water containing decomposable organic material in the concentration range of 1 ppm ($10^{-6}$) or below and in some cases up to concentrations which can be detected by well known analytical procedures.

Since such decomposable compounds in the feedwater cannot be detected readily by a conventional conductivity measurement, various procedures are utilized for detection purposes, for example, the determination of dissolved organic carbon (DOC). Neither the DOC value of a feedwater nor the content of decomposable compounds, established by other known detection methods, yields a sufficient criterion for the magnitude of increase in conductivity in the watersteam cycle (K. Hochmüller, A. Maihöfer, and L. Braunstein: "Probleme in Dampferzeugern durch nichtionogene Inhaltsstoffe des Speisewassers" ("Problems in Steam Generators By Nonionic Ingredients in the Feedwater"); VGB Kraftwerkstechnik 54 (1974), issue 3, pp. 160–174).

Efforts have been made, specifically for examining condensate to be recycled into the steam generator, of first removing the inorganic carbon compounds and the salts by means of an ion exchanger, thereafter to vaporize the water under a sufficiently high pressure, and to measure conductivity in the thus-formed condensate. This process is very expensive and time-consuming.

It is difficult to remove decomposable organic compounds from water if these compounds are present, in a large water stream, only at times and in an only very low concentration; yet this can occur practically at any time. Thus, the problem is posed of finding a process, making it possible to detect quickly and safely the decomposable organic compounds in water, down to very low concentrations, to be able to purposely remove such objectionable partial quantities from the water stream before this water enters the steam generator.

The problem has been solved in accordance with this invention by a process which involves the following operations:

removing a partial stream from the water mainstream downstream of a demineralizing installation;

continuous irradiation of the partial water stream by means of UV light in an irradiation chamber;

continuous detection of decomposition products in the irradiated water;

transferring out only that amount of water from the water mainstream for which, in the irradiated partial stream, the quantity of decomposition products lies above a predetermined limit value; and discarding this part of the water mainstream or purifying same by means of suitable purification methods.

The decomposition products formed in the irradiated water can be detected by measuring the conductivity using commercial platinum electrodes having a cell constant of about 0.1 $cm^{-1}$ or with the potentiometric method by means of commercial ion-sensitive electrodes. The halogenide ions formed during decomposition of halogenated hydrocarbons can be detected selectively to a concentration of about $10^{-7}$ mole per liter with the use of commercial electrodes sensitive for these ions.

Depending on the type of decomposable compounds, it may be advantageous to detect the decomposition products by measuring the conductivity as well as simultaneously using ion-sensitive electrodes.

The water pressure within the irradiation chamber lies somewhat above the pressure of the surroundings, for example at 1.1 bar absolute; the pressure is just high enough to allow a sufficiently rapid flow of the partial water stream through the irradiation chamber.

Nonvolatile decomposition products (e.g., chloride or sulfate) are measured in the effluent from the irradiation chamber. Volatile decomposition products are measured in the same way or they can be conducted additionally by means of a $CO_2$-free gaseous stream into a measuring cell through which flows a constant current of fully deminerealized water (i.e., FD water). The conductivity thereof lies below 0.1 $\mu$mho·cm$^{-1}$; this conductivity may be additionally measured shortly before the FD water enters the conductivity measuring cell.

Both conductivity measurements (i.e., in the effluent itself or by a conductivity measuring cell outside the effluent) can be employed in order to transfer out any objectionable feedwater from the feedwater mainstream.

Detection of the decomposition products merely by measuring the conductivity will be described hereinafter. The conductivity can additionally be measured in the partial water stream entering the irradiation chamber.

The decomposable organic compounds are decomposed by UV radiation having a wavelength of about 185 $\mu$m. The irradiation chamber consists e.g., of a 25 watt fluorescent tube about 40 cm long and about 15 mm outside diameter which is surrounded by a pipe about 30 cm long and about 20 mm inside diameter. The residence time of the water within the chamber is about 30 seconds. Additional details on the irradiation and measuring method can be derived from DOS Pat. No. 3 223 167.9. wherein it is possible to detect continuously and rapidly at low expense decomposable organic carbon compounds present in water. The organic carbon compounds are oxidized photochemically and the decomposition products are detected. For this purpose, the stream of the water to be tested is conducted through the irradiation cell and irradiated therein with UV light. The gaseous mixture present in the irradiation cell, containing the volatile decomposition products, is directed continuously into a measuring cell or into two series-connected measuring cells and continuously examined therein. A portion of the gaseous mixture is discharged with the water leaving the irradiation cell and with the water leaving the measuring cell (CM cell).

The measuring cell employed is, for example, a conductivity measuring cell (CM cell). Fully demineralized water (FD water) flows continuously through this cell with a conductivity smaller than 0.1 $\mu$mho·cm$^{-1}$. During passage of the gaseous mixture through the FD water in the CM cell, the conductivity continuously measured at the outlet of the CM cell increases. If the conductivity of the FD water flowing in the CM cell is kept adequately constant and sufficiently low, then it is enough to measure conductivity of the FD water in the proximity of the outlet from the CM cell. Otherwise, it can be advantageous to continuously measure the conductivity of the FD water before it enters the CM cell, and to utilize the increase in conductivity as a standard for the content of conductivity-raising compounds in the gaseous mixture.

An infrared (IR) analyzer can be utilized in place of the CM cell, the gaseous mixture being conducted continuously through this analyzer. The IR absorption is a measure for the content of $CO_2$ and/or other substances with IR absorption. It is possible either to measure the total absorption in a broad wavelength range, or to measure absorption at compound-specific wavelengths; in the latter case, by way of the type of compounds contained in the gaseous mixture, information is obtained with respect to the type of decomposable carbon compounds present in the water to be tested.

The gaseous mixture can first be conducted through the measuring cell of an IR analyzer and, thereafter, through a CM cell.

In many cases, it is expedient to additionally perform continuous measurement of the conductivity of the water to be tested within the irradiation cell, or at the outlet of the irradiation cell, and before entrance of the water into the irradiation cell.

The time lag between the occurrence of decomposable compounds in the mainstream and the exceeding of a set maximum conductivity in the irradiation and measuring device is determined by two individual events:

(a) by the time for transporting the partial stream from its branch-off point from the mainstream to the irradiating and measuring device;

(b) by the time from the entrance of the partial stream into the irradiation and measuring device to the exceeding of the set maximum conductivity.

Time (a) is dependent on the length of and throughflow velocity in the partial stream conduit; this time period should be kept maximally brief. Time (b) is specific to the apparatus and amounts, as the $t_{90}$ time, to less than 30 seconds. $t_{90}$ denotes the time within which the increase of conductivity reaches 90% of its maximum value. A time span of less than 40 seconds occurs between entrance of the partial water stream into the irradiation and measuring device and the first detection of the decomposition products in the irradiated water.

As soon as the conductivity found in the irradiation and measuring device exceeds a predetermined value, the mainstream is directed, for the time period during which the predetermined value is exceeded, to a wastewater discharge unless it is feasible to cleanse the stream of the decomposable compounds. After conductivity has returned to the realm of the desired values, the mainstream (after a certain time delay) is again directed into the storage tank and fed into the steam generator. Depending on the technical expenditure, the associated valves can be operated either manually or fully automatically by the continuously measured conductivity.

The mainstream is discharged or cleansed whenever the conductivity of the effluent from the irradiation chamber increases by e.g., 0.25 $\mu$mho·cm$^{-1}$ or more and that independently from the composition of the decomposed organic compound.

Since water treatment plants considerably differ from one another with respect to construction and operation, due to locally differing conditions, the optimum branching-off point for the partial water stream must be fixed for each individual case. In any event, however, the partial water stream must have been demineralized, or it must be demineralized prior to entering the irradiation and measuring device.

The process of this invention exhibits the following advantages.

Decomposable organic compounds can be continuously detected in time, before the water containing these compounds enters the steam generator. Thus, contaminated partial quantities can be transferred out in a controlled and safe fashion so that they can be discarded or introduced into an additional purifying stage.

Continuous monitoring of the efficiency of process stages for removing decomposable compounds from water (e.g., activated carbon filters) is made possible.

The decomposable compounds are very rapidly decomposed under UV light; the decomposition products are very quickly detected by means of conductivity measurement or by means of ion-sensitive electrodes.

It is very sensitive and permits detection of decomposable compounds down to 1 part per billion (i.e. $10^{-9}$).

The irradiation and measuring device can be calibrated if the composition of the decomposable compounds present in the water is known. Calibration remains unchanged over continuous operation of one month's duration.

As experience has shown, the water or the steam may be contaminated with decomposable organic compounds on account of various processes such as:

Decomposable organic compounds can occur in untreated water (e.g., surface water) at any time, in some cases, only for a short time and in low concentration.

Spontaneous breakthrough and flushing processes may be encountered when operating an activated carbon filter with water containing decomposable organic compounds.

Ion exchange resins in the demineralizing plant may release decomposable organic substances for various reasons into the water passing therethrough.

In chemical installations, the steam or the condensate may be contaminated with small amounts of chemical compounds due to intermittently not entirely tight partitions between the steam or condensate chamber, on the one hand, and the space where these chemical compounds are located, on the other hand.

Figure 2:
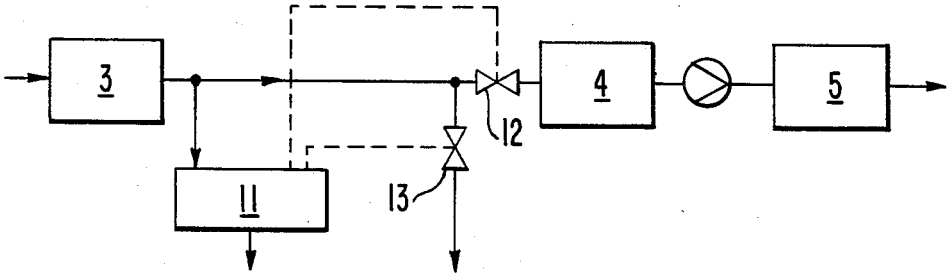
Figure 3:
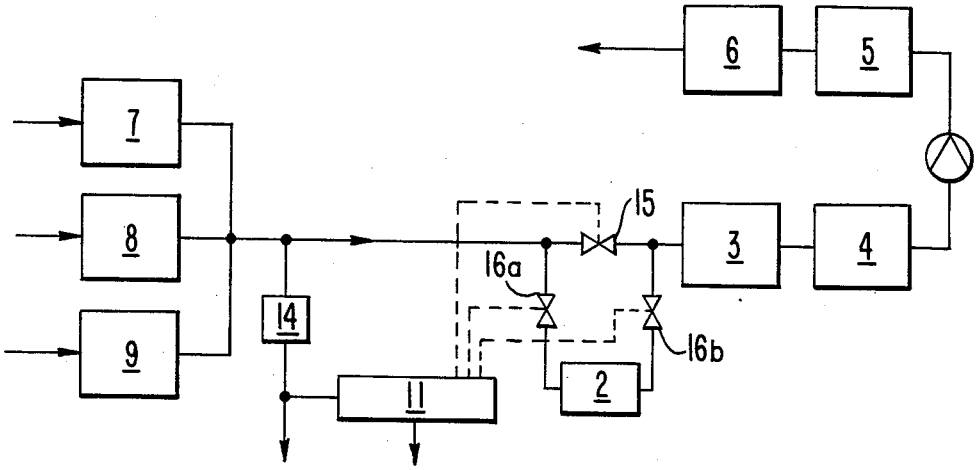
Figure 4:
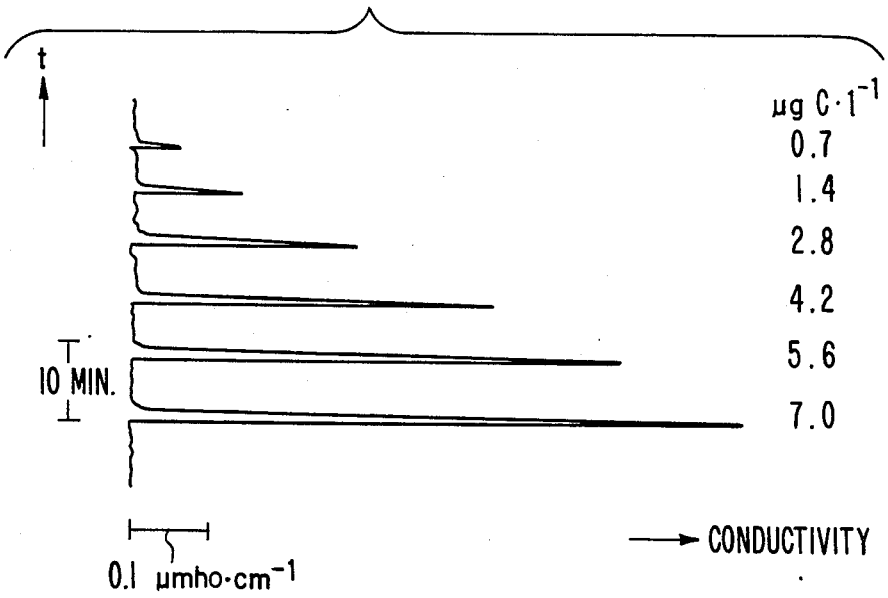

The invention is illustrated by means of the attached figures. These figures show:

FIG. 1 - Schematic representation of the conventional arrangement of a feed water system for a steam generating plant FIG. 2 - Schematic representation of a feed water system in accordance with the present invention for protecting steam generators from material damage FIG. 3 - Another embodiment of a feed water system having means for protecting the steam generator from damage due to organic decomposable compounds in the feed water FIG. 4 - Record of conductivity of water as measured by a conductivity cell within the irradiation and measuring device.

The customary structure of a steam generating plant with power-heat linkage is illustrated in FIG. 1. Water is selectively conducted from several untreated-water sources 1 by way of an activated carbon filter 2 or directly by way of ion exchangers of a demineralizing installation 3 into a feedwater tank 4. From there, a steam generator 5 is supplied with water. The thus-generated steam passes, either as high-pressure steam branched off in front of the turbine 6 or as low-pressure steam downstream of the turbine, into several chemical plants 7, 8 and 9. After the steam has fulfilled its specific objective in the chemical plants, it leaves the latter as a condensate fed via a collecting conduit to a condensate reservoir 10. The collected condensate is returned into the untreated water conduit upstream of the water processing installation.

The process of this invention will be explained by way of example, using two specific embodiments.

EXAMPLE 1

With the aid of commercial ion exchangers 3, 200 $m^3$ of untreated water per hour is demineralized (conductivity less than 0.1 $\mu mho \cdot cm^{-1}$) is a commercial demineralization installation.

The outlet of the demineralization installation is connected by a pipeline (internal diameter 250 mm, length 150 m) with a feedwater tank 4 (FIG. 2), supplying 200 $m^3 \cdot h^{-1}$ of FD water at a flow rate of 68 $m \cdot min^{-1}$ to the feedwater tank. The volume of the feedwater tank is 800 $m^3$. By means of a pump, a steam generator is supplied from the tank with 200 $m^3$ of boiler feedwater per hour. In the connecting conduit between the demineralizing installation and the feedwater tank, a partial stream of about 3 $l \cdot h^{-1}$ is conducted from the water mainstream, directly downstream of the last ion exchanger, to the irradiation and measuring device 11. An electrically controlled valve 12 is arranged in the mainstream conduit a short distance upstream of the feedwater tank, and a short distance upstream thereof, a branch-off conduit is located, likewise with an electrically controlled valve 13, leading to the wastewater.

If the conductivity indicated by the irradiation and measuring device is below a predetermined desired value, i.e., if the increase of conductivity is less than e.g., 0.25 $\mu mho \cdot cm^{-1}$, valve 12 in the mainstream conduit is opened, and valve 13 in the wastewater conduit is closed. As soon as the irradiation and measuring device indicates that the predetermined maximum conductivity value has been exceeded, i.e., that the increase of conductivity is more than e.g., 0.25 $\mu mho \cdot cm^{-1}$, the valve in the wastewater conduit is immediately opened, and the valve in the mainstream conduit upstream of the feedwater tank is closed. As soon as the irradiation and measuring device, after a trouble incident, returns to indicating a conductivity lying within the desired range, valves 12 and 13 are switched over again three minutes later, and unobjectionable FD water passes again into the feedwater tank.

EXAMPLE 2

Three chemical plants 7, 8 and 9 are supplied with lowpressure steam downstream of a turbine 6 (FIG. 3). The three condensate streams (50 $m^3 \cdot h^{-1}$; 80 $m^3 \cdot h^{-1}$; and 30 $m^3 \cdot h^{-1}$) leaving the chemical plants are combined into a condensate collecting conduit (200 mm internal diameter). The 160 $m^3$ of condensate per hour are recycled at a flow rate of 85 $m \cdot min^{-1}$ over a condensate conduit having a length of 450 m to the demineralizing installation 3, demineralized therein by way of ion exchangers, and conveyed via the feedwater tank 4 by means of a pump into the steam generator 5.

Directly after combining the three individual condensate streams into the condensate collecting conduit, a partial stream of 30 $l \cdot h^{-1}$ therefrom is demineralized by way of a commercial ion exchanger 14, and 3 $l \cdot h^{-1}$ thereof is introduced into the irradiation and measuring device 11. A commercial activated carbon filter 2 is arranged in a bypass conduit shortly upstream of the commercial demineralizing installation 3 for the condensate mainstream.

As soon as the irradiation and measuring device indicates that a predetermined maximum conductivity value has been exceeded, the two electrically controlled valves 16*a* and 16*b* in the bypass conduit are immediately opened upstream and downstream of the activated carbon filter, and the interposed valve 15 in the condensate collecting conduit is closed. The condensate is, in this case, additionally passed via the active carbon filter 2 before reaching the demineralizing installation 3. As soon as the irradiation and measuring device, after a trouble incident, again indicates a conductivity lying within the desired range, the valve 15 in the mainstream conduit is opened 15 minutes later, and the two valves 16*a* and 16*b* in the pypass line upstream and downstream of the active carbon filter are closed.

FIG. 4 is a record of conductivity of water as measured by a commercial conductivity cell within the irradiation and measuring device. For this test very small amounts of carbon tetrachloride (diluted with water) were specifically injected into the partial stream of demineralized water before entering the device 11 in FIG. 2. Within the device 11 this compound was decomposed completely by UV light in an irradiation chamber. The decomposition products were detected by measuring and recording the conductivity of the irradiated water which was drained from the irradiation chamber. Due to the discontinuous injection of carbon tetrachloride into the continuous flow of FD water the records show several peaks ofconductivity as shown in FIG. 4.

During the test which resulted in the record of FIG. 4 different amounts of carbon tetrachloride were injected into the FD water in time intervals of about 7 minutes. The amount of carbon tetrachloride was varied and was corresponding to the carbon quantities in the maximum of conductivity indicated in FIG. 4 (0.7 to 7.0 $\mu g\ C \cdot l^{-1}$). FIG. 4 demonstrates the rapid rise in conductivity in the irradiation chamber as soon as the decomposable compounds are decomposed therein. The conductivity maximum is reached after about 20 seconds.

The recorder was adjusted in such a manner that it recorded zero conductivity for the FD water without any carbon tetrachloride added. According to FIG. 4 the increase in conductivity caused by different amounts of decomposed carbon tetrachloride varies from 0.05 to about 0.8 $\mu mho \cdot cm^{-1}$. the recorded conductivity of e.g. 0.5 $\mu mho \cdot cm^{-1}$ in the maximum corresponds to about 4.2 $\mu g\ C \cdot l^{-1}$ resulting from completely decomposed carbon tetrachloride.

What is claimed is:

1. A process for protecting steam generators from material damage caused by decomposition products of decomposable organic compounds present in the feedwater, which comprises:

removing a partial stream from a feedwater mainstream downstream of a demineralizing installation;

effecting continuous irradiation of the partial water stream with UV light in an irradiation chamber;

effeting continuous detection of decomposition products formed in the irradiated water;

transferring out only that amount of water from the water mainstream for which, in the irradiated partial stream, the quantity of decomposition products lies above a predetermined limit value;

discarding said transferred-out amount of the water mainstream or purifying same.

2. A process according to claim 1, which further comprises additionally measuring the conductivity in the partial water stream prior to its entrance into the irradiation chamber.

3. A process according to claim 1, wherein continuous detection of the decomposition products in the irradiated water is effected by ion-sensitive electrodes upon exiting from the irradiation chamber.

4. A process according to claim 1, wherein a time span of less than 40 seconds occurs between entrance of the partial water stream into the irradiation and measuring device and the detection of the decomposition products in the irradiated water.

5. A process according to claim 1, wherein continuous detection of the decompostion products in the irradiated water is effected by measuring the conductivity of the irradiated water exiting from the irradiation chamber.

6. A process according to claim 5, wherein continuous detection of the decomposition products includes directing volatile decomposition products to a measuring cell, through which flows fully demineralized water with a conductivity of below 0.1 $\mu mho \cdot cm^{-1}$ by use of a $CO_2$ free gaseous stream and effecting continuous measurement of conductivity of the fully demineralized water prior to its entrance into the measuring cell.

* * * * *